US009280094B1

(12) United States Patent
Bacelieri et al.

(10) Patent No.: US 9,280,094 B1
(45) Date of Patent: Mar. 8, 2016

(54) TRIM BAR ENTRY GEOMETRY FOR A DUAL COMPONENT DEVELOPMENT ELECTROPHOTOGRAPHIC IMAGE FORMING DEVICE

(71) Applicant: Lexmark International, Inc., Lexington, KY (US)

(72) Inventors: Michael Brian Bacelieri, Lexington, KY (US); Robert Dan Bennett, III, Paris, KY (US); Gary Allen Denton, Lexington, KY (US); Katherine Marie Gilliam, Lexington, KY (US); Elliott Vincent Jernigan, Lexington, KY (US); Matthew Lee Rogers, Lexington, KY (US); Dominique Renee Rowe, Lexington, KY (US); Courtney Harrison Soale, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/618,172

(22) Filed: Feb. 10, 2015

(51) Int. Cl.
*G03G 15/09* (2006.01)
*G03G 15/08* (2006.01)

(52) U.S. Cl.
CPC ..... *G03G 15/0928* (2013.01); *G03G 15/0891* (2013.01)

(58) Field of Classification Search
None
See application file for complete search history.

(56) References Cited

U.S. PATENT DOCUMENTS 5,177,536 A 1/1993 Watanabe et al.
2012/0230737 A1 * 9/2012 Nakajima et al. ..... 399/267

OTHER PUBLICATIONS

Annotated diagram of prior art dual component development developer unit (Attached—1 page).
Annotated diagrams of prior art dual component development developer units (Attached—14 pages).

* cited by examiner

*Primary Examiner* — Clayton E Laballe
*Assistant Examiner* — Jas Sanghera
(74) *Attorney, Agent, or Firm* — Justin M Tromp

(57) ABSTRACT

A developer unit for a dual component development electrophotographic image forming device according to one example embodiment includes a housing having a reservoir for storing a developer mix that includes toner and magnetic carrier beads. An auger is positioned to convey developer mix in the reservoir toward the outer surface of a magnetic roll on a front of the housing. A ledge on an inner surface of the housing extends axially with respect to the magnetic roll along a front of the reservoir. The ledge is positioned upstream from a trim bar and downstream from a pickup pole of the magnetic roll with respect to the operative rotational direction of the magnetic roll. The ledge has a concave curved inner surface that is open to the reservoir and extends from near the trim bar to near a front side of the auger.

14 Claims, 7 Drawing Sheets

TRIM BAR ENTRY GEOMETRY FOR A DUAL COMPONENT DEVELOPMENT ELECTROPHOTOGRAPHIC IMAGE FORMING DEVICE

CROSS REFERENCES TO RELATED APPLICATIONS

None.

BACKGROUND

1. Field of the Disclosure

The present disclosure relates generally to image forming devices and more particularly to a trim bar entry geometry for a dual component development electrophotographic image forming device.

2. Description of the Related Art

Dual component development electrophotographic image forming devices include one or more reservoirs that store a mixture of toner and magnetic carrier beads (the "developer mix"). Toner is electrostatically attracted to the carrier beads as a result of triboelectric interaction between the toner and the carrier beads. A magnetic roll includes a stationary core having one or more permanent magnets and a sleeve that rotates around the core. The magnetic roll attracts the carrier beads in the reservoir having toner thereon to the outer surface of the sleeve through the use of magnetic fields from the core. A photoconductive drum in close proximity to the sleeve of the magnetic roll is charged by a charge roll to a predetermined voltage and a laser selectively discharges areas on the surface of the photoconductive drum to form a latent image on the surface of the photoconductive drum. The sleeve is electrically biased to facilitate the transfer of toner from the developer mix on the outer surface of the sleeve to the discharged areas on the surface of the photoconductive drum forming a toner image on the surface of the photoconductive drum. The photoconductive drum then transfers the toner image, directly or indirectly, to a media sheet forming a printed image on the media sheet.

As the developer mix on the outer surface of the sleeve approaches the photoconductive drum by rotation of the sleeve, the developer mix is trimmed to a desired mass on the magnetic roll by a trim bar. A gap between the trim bar and the outer surface of the sleeve (the "trim bar gap") dictates how much developer mix is allowed to pass on the outer surface of the sleeve from the reservoir toward the photoconductive drum. The permanent magnet(s) include a pickup pole positioned upstream from the trim bar gap that magnetically attracts developer mix in the reservoir to the outer surface of the sleeve. A portion of the developer mix in the reservoir is positioned in a region of the reservoir between the pickup pole and the trim bar gap in proximity to the outer surface of the sleeve. This region of the reservoir is responsible for ensuring that an adequate amount of developer mix is available for transfer onto the outer surface of the sleeve in order to prevent print defects. This region of the reservoir is also responsible for a portion of the triboelectric charging of the toner through interaction between the toner and the carrier beads.

SUMMARY

A developer unit for a dual component development electrophotographic image forming device according to one example embodiment includes a housing having a reservoir for storing a developer mix that includes toner and magnetic carrier beads. A magnetic roll is positioned on a front of the housing. The magnetic roll includes a stationary core and a sleeve positioned around the core that is rotatable relative to the core about an axis of rotation. The stationary core includes at least one permanent magnet having a plurality of circumferentially spaced magnetic poles. The plurality of circumferentially spaced magnetic poles includes a pickup pole that is positioned to magnetically attract developer mix in the reservoir to the outer surface of the sleeve for carrying by the sleeve as the sleeve rotates. A trim bar is positioned in close proximity to the outer surface of the sleeve downstream from the pickup pole relative to an operative rotational direction of the sleeve to trim the developer mix on the outer surface of the sleeve prior to carrying the developer mix to a photoconductive drum of image forming device. An auger is positioned to convey developer mix in the reservoir toward the outer surface of the sleeve for pickup by the outer surface of the sleeve. A ledge on an inner surface of the housing extends axially with respect to the magnetic roll along a front of the reservoir. The ledge is positioned upstream from the trim bar and downstream from the pickup pole with respect to the operative rotational direction of the sleeve. The ledge has a concave curved inner surface that is open to the reservoir and extends from a top front edge of the ledge positioned near the trim bar to a bottom rear edge of the ledge positioned near a front side of the auger.

A developer unit for a dual component development electrophotographic image forming device according to another example embodiment includes a housing having a reservoir for storing a developer mix that includes toner and magnetic carrier beads. A magnetic roll is positioned on a front of the housing. The magnetic roll includes a stationary core and a sleeve positioned around the core that is rotatable relative to the core about an axis of rotation. The stationary core includes at least one permanent magnet. The outer surface of the sleeve is positioned to carry developer mix attracted from the reservoir to the outer surface of the sleeve by the at least one permanent magnet. A trim bar is positioned in close proximity to the outer surface of the sleeve to trim the developer mix on the outer surface of the sleeve prior to carrying the developer mix to a photoconductive drum of image forming device. An auger is positioned to convey developer mix in the reservoir toward the outer surface of the sleeve for pickup by the outer surface of the sleeve. A ledge on an inner surface of the housing extends axially with respect to the magnetic roll along a front of the reservoir. The ledge is positioned vertically below a bottommost point of the outer surface of the sleeve and vertically above a centerline of the auger when the developer unit is in its operative orientation. The ledge has a concave curved inner surface that is open to the reservoir and extends from a top front edge of the ledge positioned near the trim bar to a bottom rear edge of the ledge positioned near a front side of the auger. An upper portion of the auger extends vertically higher than the bottom rear edge of the ledge when the developer unit is in its operative orientation.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
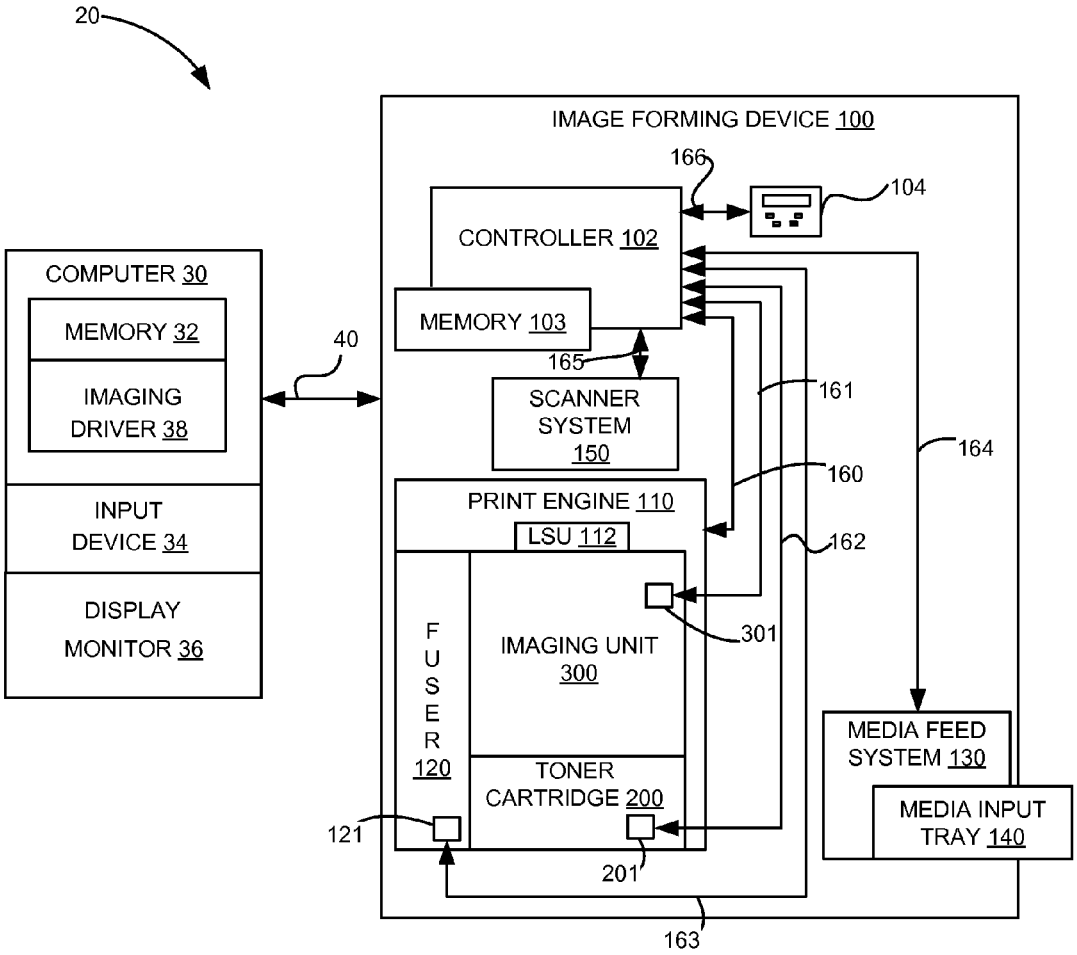
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (MO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103. The processor may include one or more integrated circuits in the form of a microprocessor or central processing unit and may be formed as one or more Application Specific Integrated Circuits (ASICs). Memory 103 may be any volatile or non-volatile memory or combination thereof, such as, for example, random access memory (RAM), read only memory (ROM), flash memory and/or nonvolatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory, such as RAM, ROM, and/or NVRAM, and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer, such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
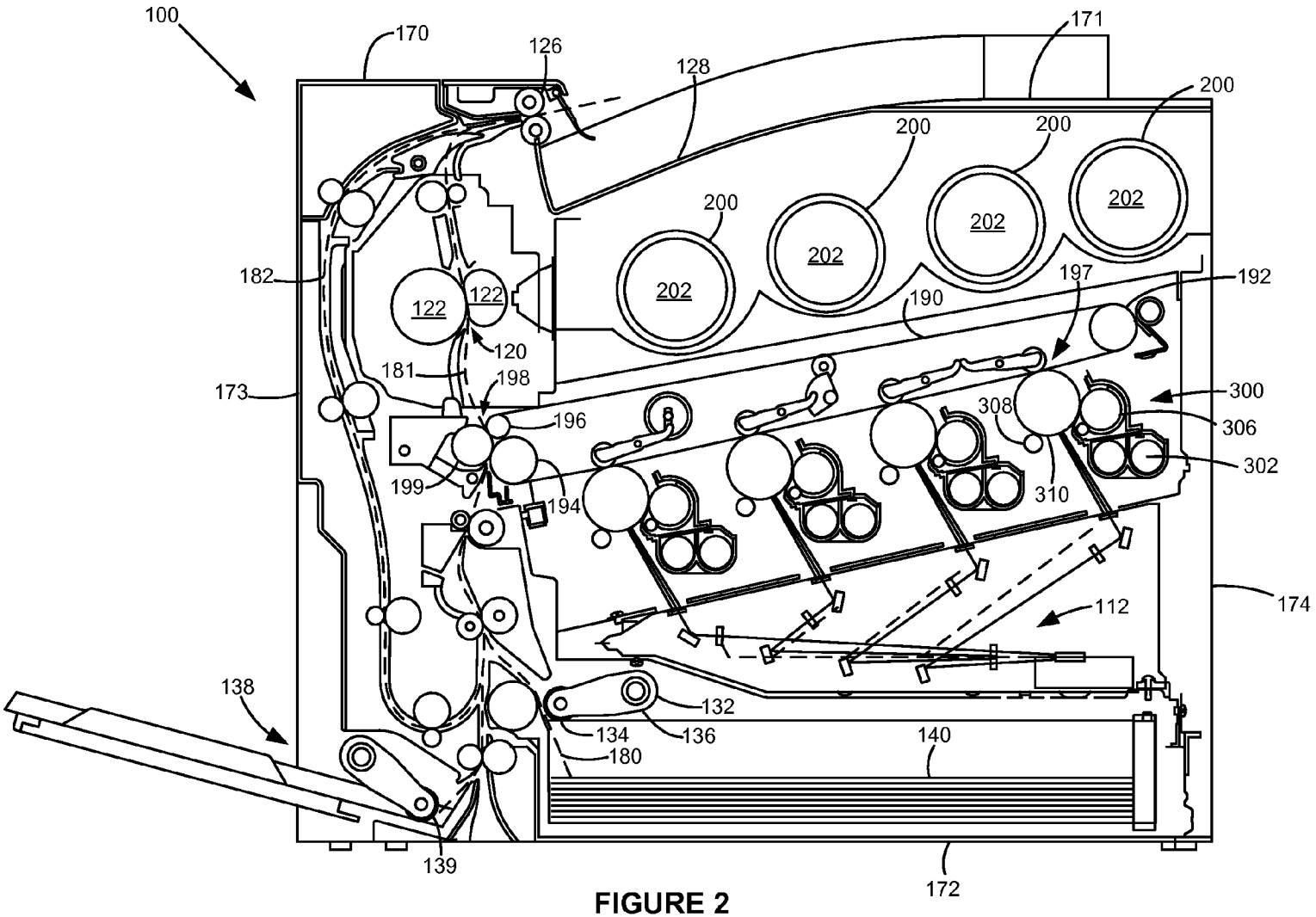
FIG. 2 is a schematic diagram of an image forming device according to one example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable or refilling. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300, which may also be removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include yellow, cyan, magenta and black toner.

Image forming device 100 utilizes what is commonly referred to as a dual component development system. Each imaging unit 300 includes a reservoir 302 that stores a mixture of toner and magnetic carrier beads. The carrier beads may be coated with a polymeric film to provide triboelectric properties to attract toner to the carrier beads as the toner and the carrier beads are mixed in reservoir 302. Reservoir 302 and a magnetic roll 306 collectively form a developer unit. Each imaging unit 300 also includes a charge roll 308 and a photoconductive (PC) drum 310 and a cleaner blade or roll (not shown) that collectively form a. PC unit. PC drums 310 are mounted substantially parallel to each other when the imaging units 300 are installed in image forming device 100. In the example embodiment illustrated, each imaging unit 300 is substantially the same except for the color of toner contained therein.

Each charge roll 308 forms a nip with the corresponding PC drum 310. During a print operation, charge roll 308 charges the surface of PC drum 310 to a specified voltage, such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Magnetic roll 306 attracts the carrier beads in reservoir 302 having toner thereon to magnetic roll 306 through the use of magnetic fields and transports the toner to the corresponding PC drum 310. Electrostatic forces from the latent image on PC drum 310 strip the toner from the carrier beads to form a toner image on the surface of PC drum 310.

An intermediate transfer mechanism (ITM) 190 is disposed adjacent to the PC drums 310. In this embodiment, ITM 190 is formed as an endless belt trained about a drive roll 192, a tension roll 194 and a hack-up roll 196. During image forming operations, ITM 190 moves past PC drums 310 in a clockwise direction as viewed in FIG. 2. One or more of PC drums 310 apply toner images in their respective colors to ITM 190 at a first transfer nip 197, in one embodiment, a positive voltage field attracts the toner image from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196. The cleaner blade/roll removes any toner remnants on PC drum 310 so that the surface of PC drum 310 may be charged and developed with toner again.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

While the example image forming device 100 shown in FIG. 2 illustrates four toner cartridges 200 and four corresponding imaging units 300, it will be appreciated that a monocolor image forming device 100 may include a single toner cartridge 200 and corresponding imaging unit 300 as compared to a color image forming device 100 that may include multiple toner cartridges 200 and imaging units 300. Further, although image forming device 100 utilizes ITM 190 to transfer toner to the media, toner may be applied directly to the media by the one or more photoconductive drums 310 as is known in the art. In addition, toner may be transferred directly from each toner cartridge 200 to its corresponding imaging unit 300 or the toner may pass through an intermediate component, such as a chute, duct or hopper, that connects the toner cartridge 200 with its corresponding imaging unit 300.

Imaging unit(s) 300 may be replaceable in any combination desired. For example, in one embodiment, the developer unit and PC unit are provided in separate replaceable units from each other. In another embodiment, the developer unit and PC unit are provided in a common replaceable unit. In another embodiment, toner reservoir 202 is provided with the developer unit instead of in a separate toner cartridge 200. For a color image forming device 100, the developer unit and PC unit of each color toner may be separately replaceable or the developer unit and/or the PC unit of all colors (or a subset of all colors) be replaceable collectively as desired.

Figure 3:
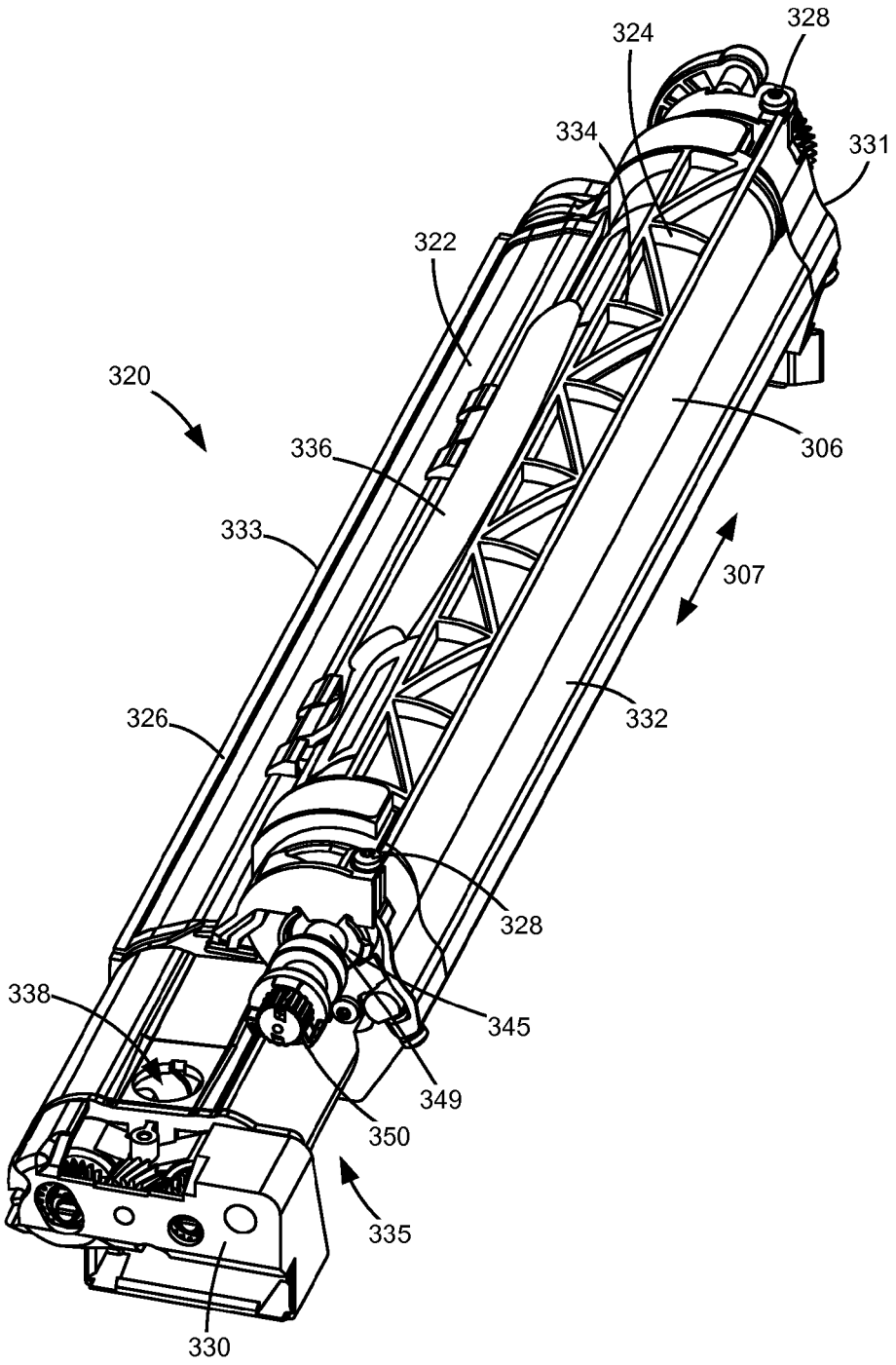
FIG. 3 is a perspective view of a developer unit according to one example embodiment.
Figure 4:
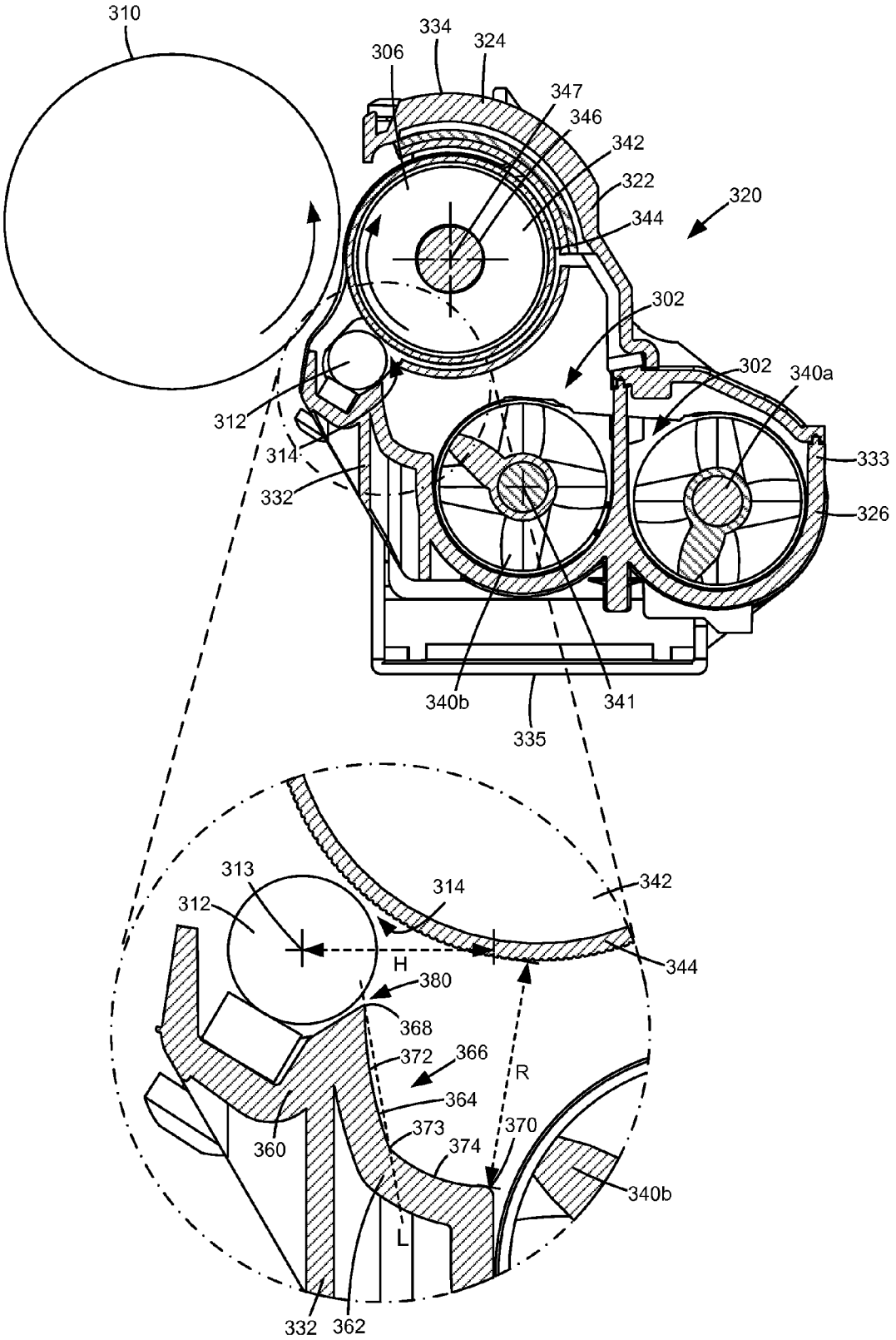
FIG. 4 is a cross-sectional view of the developer unit shown in FIG. 3.

FIGS. 3 and 4 show a developer unit 320 according to one example embodiment. Developer unit 320 includes a housing 322 having reservoir 302 therein. In the example embodiment illustrated, housing 322 includes a lid 324 mounted on a base 326. Lid 324 may be attached to base 326 by any suitable construction including, for example, by fasteners (e.g., screws 328), adhesive and/or welding. Housing 322 extends generally along an axial direction 307 of magnetic roll 306 from a first side 330 of housing 322 to a second side 331 of housing 322. Side 330 leads during insertion of developer unit 320 into image forming device 100. A portion of magnetic roll 306 is exposed at a front 332 of housing 322. A handle 336 is optionally positioned on a rear 333 of housing 322 to assist with separating developer unit 320 from the corresponding PC unit. Housing 322 also includes a top 334 and a bottom 335.

Reservoir 302 holds the mixture of toner and magnetic carrier beads (the "developer mix"). Developer unit 320 includes an inlet port 338 in fluid communication with reservoir 302 and positioned to receive toner from toner cartridge 200 to replenish reservoir 302 when the toner concentration in reservoir 302 relative to the amount of carrier beads remaining in reservoir 302 gets too low as toner is consumed from reservoir 302 by the printing process. In the example embodiment illustrated, inlet port 338 is positioned on top 334 of housing 322 near side 330; however, inlet port 338 may be positioned at any suitable location on housing 322.

Reservoir 302 includes one or more agitators to stir and move the developer mix. For example, in the embodiment illustrated, reservoir 302 includes a pair of augers 340*a*, 340*b*. Augers 340*a*, 340*b* are arranged to move the developer mix in opposite directions along the axial length of magnetic roll 306. For example, auger 340*a* is positioned to incorporate toner from inlet port 338 and to move the developer mix away from side 330 and toward side 331. Auger 340*b* is positioned to move the developer mix away from side 331, toward side 330 and in proximity to the bottom of magnetic roll 306. This arrangement of augers 340*a*, 340*b* is sometimes informally referred to as a racetrack arrangement because of the circular path the developer mix in reservoir 302 takes when augers 340*a*, 340*b* rotate.

With reference to FIG. 1, magnetic roll 306 includes a core 342 that includes one or more permanent magnets and that does not rotate relative to housing 322. A cylindrical sleeve 344 encircles core 342 and extends along the axial length of magnetic roll 306. A shaft 346 passes through the center of core 342 and defines an axis of rotation 347 of magnetic roll 306. Shaft 346 is fixed, i.e., shaft 346 does not rotate with sleeve 344 relative to housing 322, and controls the position of core 342 relative to sleeve 344 and to the other components of developer unit 320. With reference back to FIG. 3, a rotatable end cap 345 is positioned at one axial end of magnetic roll 306, referred to as the drive side of magnetic roll 306. End cap 345 is coupled to sleeve 344 such that rotation of end cap 345 causes sleeve 344 to rotate around core 342. Sleeve 344 rotates in a clockwise direction as viewed in FIG. 4 to transport the developer mix from reservoir 302 to PC drum 310. A drive coupler 350 is operatively connected to end cap 345 either directly, such as on an end of a shaft 349 that extends axially outward from end cap 345 as shown in the example embodiment illustrated, or indirectly. Drive coupler 350 is positioned to receive rotational force from a corresponding drive coupler in image forming device 100 when developer unit 320 is installed in image forming device 100. Any suitable drive coupler 350 may be used as desired, such as a toothed gear or a drive coupler that receives rotational force at its axial end. In one embodiment, augers 340*a*, 340*b* are operatively connected to drive coupler 350 by one or more intermediate gears (not shown). Alternatively, augers 340*a*, 340*b* may be driven independently of drive coupler 350 and sleeve 344 by a second drive coupler positioned to receive rotational force from a corresponding drive coupler in image forming device 100 when developer unit 320 is installed in image forming device 100.

Figure 5:
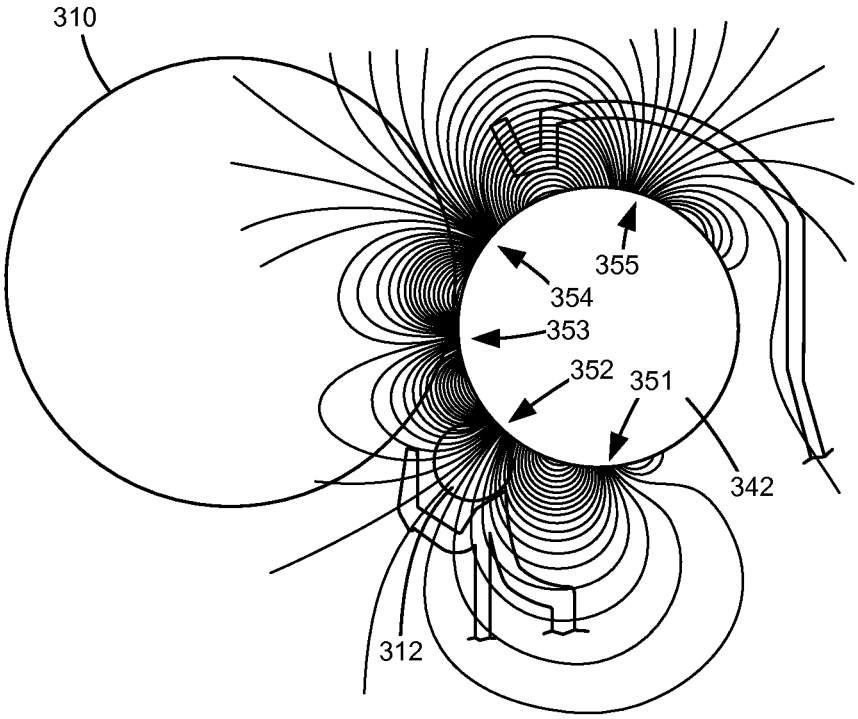
FIG. 5 is a schematic diagram of the developer unit of FIGS. 3 and 4 showing the magnetic field lines of a magnetic roll according to one example embodiment.

With reference to FIGS. 4 and 5, the permanent magnet(s) of core 342 include a series of circumferentially spaced, alternating (south v. north) magnetic poles that facilitate the transport of developer mix to PC drum 310 as sleeve 344 rotates. FIG. 5 shows the magnetic field lines generated by the magnetic poles of core 342 according to one example embodiment. Core 342 includes a pickup pole 351 positioned near the bottom of core 342 (near the 6 o'clock position of core 342 as viewed in FIG. 5). Pickup pole 351 magnetically attracts developer mix in reservoir 302 to the outer surface of sleeve 344. The magnetic attraction from core 342 causes the developer mix to form cone or bristle-like chains that extend from the outer surface of sleeve 344 along the magnetic field lines.

After the developer mix is picked up at pickup pole 351, as sleeve 344 rotates, the developer mix on sleeve 344 advances toward a trim bar 312. Trim bar 312 is positioned in close proximity to the outer surface of sleeve 344. Trim bar 312 trims the chains of developer mix as they pass to a predetermined average height defined by a trim bar gap 314 formed between trim bar 312 and the outer surface of sleeve 344 in order to control the mass of developer mix on the outer surface of sleeve 344. Trim bar gap 314 dictates how much developer mix is allowed to pass on the outer surface of sleeve 344 from reservoir 302 toward PC drum 310. Trim bar 312 may be magnetic or non-magnetic and may take a variety of different shapes including having a flat or rounded trimming surface. Trim bar 312 may be electrically biased to aid in trimming the chains of developer mix. Core 342 includes a trim pole 352 positioned at trim bar 312 to stand the chains of developer mix up on sleeve 344 in a generally radial orientation for trimming by trim bar 312. As shown in FIG. 5, between pickup pole 351 and trim pole 352, the chains of developer mix on sleeve 344 have a primarily tangential (as opposed to radial) orientation relative to the outer surface of sleeve 344 according to the magnetic field lines between pickup pole 351 and trim pole 352.

As sleeve 344 rotates further, the developer mix on sleeve 344 passes in close proximity to the outer surface of PC drum 310. As discussed above, electrostatic forces from the latent image formed on PC drum 310 by the laser beam from LSU 112 strip the toner from the carrier beads to form a toned image on the surface of PC drum 310. Core 342 includes a developer pole 353 positioned at the point where the outer surface of sleeve 344 passes in close proximity to the outer surface of PC drum 310 to once again stand the chains of developer mix up on sleeve 344 in a generally radial orientation to promote the transfer of toner from sleeve 344 to PC drum 310. The developer mix is less dense and less coarse when the chains of developer mix are stood up in a generally radial orientation than it is when the chains are more tangential. As a result, less wear occurs on the surface of PC drum 310 from contact between PC drum 310 and the chains of developer mix when the chains of developer mix on sleeve 344 are in a generally radial orientation.

As sleeve 344 continues to rotate, the remaining developer mix on sleeve 344, including the toner not transferred to PC drum 310 and the carrier beads, is carried by magnetic roll 306 past PC drum 310 and back toward reservoir 302. Core 342 includes a transport pole 354 positioned past the point where the outer surface of sleeve 344 passes in close proximity to the outer surface of PC drum 310. Transport pole 354 magnetically attracts the remaining developer mix to sleeve 344 to prevent the remaining developer mix from migrating to PC drum 310 or otherwise releasing from sleeve 344. As sleeve 344 rotates further, the remaining developer mix passes under lid 324 and is carried back to reservoir 302 by magnetic roll 306. Core 342 includes a release pole 355 positioned near the top of core 342 along the direction of rotation of sleeve 344. Release pole 355 magnetically attracts the remaining developer mix to sleeve 344 as the developer mix is carried the remaining distance to the point where it is released back into reservoir 302. As the remaining developer mix passes the 2 o'clock position of core 342 as viewed in FIG. 5, the developer mix is no longer magnetically retained against sleeve 344 by core 342 allowing the developer mix to fall via gravity and centrifugal force back into reservoir 302.

FIGS. 4 and 5 show developer unit 320 in its operative orientation with the outer surface of sleeve 344 of magnetic roll 306 in close proximity to PC drum 310 for transferring toner from reservoir 302 to PC drum 310. With reference to the enlarged portion of FIG. 4, a front wall 360 at the front 332 of housing 322 includes a ledge 362 formed on an inner surface of front wall 360 near the outer surface of sleeve 344 of magnetic roll 306 at the front 332 of reservoir 302. Ledge 362 is positioned upstream of trim bar 312 and downstream of pickup pole 351 with respect to the operative rotational direction of sleeve 344. Ledge 362 extends axially with respect to magnetic roll 306 along substantially the entire axial length of magnetic roll 306. Ledge 362 is positioned vertically below the outer surface of sleeve 344 of magnetic roll 306 and a centerline 313 of trim bar 312 and vertically above a centerline 341 of adjacent auger 340*b* when developer unit 320 is in its operative orientation.

Ledge 362 includes a concave inner surface 364 that is open to reservoir 302. Concave inner surface 364 extends from a top front edge 368 of ledge 362 to a bottom rear edge 370 of ledge 362. Top front edge 368 of ledge 362 is positioned in close proximity to a rear side of trim bar 312. Bottom rear edge 370 of ledge 362 is positioned in close proximity to a front side of auger 340*b*. The concavity of ledge 362 forms a region 366 of reservoir 302 angularly between pickup pole 351 and trim bar 312 with respect to the operative rotational direction of sleeve 344. Region 366 is shaped and positioned to store developer mix in close proximity to the outer surface of sleeve 344 in order to feed developer mix to sleeve 344 as sleeve 344 rotates. Region 366 permits more axially uniform flow of developer mix onto the outer surface of sleeve 344 in comparison with sleeve 344 pulling developer mix directly from auger 340*b*. The developer mix in region 366 tends to form along the magnetic field lines of the magnetic poles of core 342.

From bottom rear edge 370 of ledge 362, the inner surface of front wall 360 extends downward toward bottom 335 wrapping in close proximity to the outer edge of the flight of auger 340*b*. An upper portion of auger 340*b* extends vertically higher than bottom rear edge 370 of ledge 362. As augers 340*a*, 340*b* rotate, in addition to moving the developer mix axially away from side 331 and toward side 330, auger 340*h* pushes developer mix toward the outer surface of sleeve 344 and into region 366 to help circulate the developer mix in region 366 and to introduce fresh developer mix from reservoir 302 to the developer mix trimmed off of the outer surface of sleeve 344 by trim bar 312. The circulation of the developer mix in region 366 is responsible for a portion of the triboelectric charging of the toner for transfer to the latent image on PC drum 310. In one embodiment, the pitch to diameter ratio of auger 340*b* is between 1.2 and 1.5 such that the developer mix moved by auger 340*b* moves more tangentially than axially to feed a sufficient amount of developer mix to region 366 to mix the developer mix in region 366. In contrast, a pitch to diameter ratio of less than one results in more axial flow than tangential flow.

Ledge 362 is shaped and positioned to promote flow and mixing of developer mix in region 366 for pickup by sleeve 344. In the example embodiment illustrated, concave inner surface 364 of ledge 362 is a curved surface having front portion 372 that faces primarily rearward toward the rear 333 of housing 302 and a bottom portion 374 that faces primarily upward toward the top 334 of housing 302. In some embodiments, front portion 372 of surface 364 has a greater radius of curvature than bottom portion 374 of surface 364. In one example embodiment, the radius of curvature of front portion 372 is about 19.3 min and the radius of curvature of bottom portion 374 is about 6.6 mm. In one embodiment, the curvature of front portion 372 is sloped such that a line L drawn between top front edge 368 of ledge 362 and a bottom point 373 of front portion 372 of surface 364 (where concave inner surface 364 transitions from facing primarily rearward to facing primarily upward) forms an angle of between about 6 degrees and about 15 degrees (such as, for example between about 7 degrees and about 13 degrees or equal to about 10 degrees) with respect to vertical when developer unit 320 is in its operative orientation.

Figure 6:
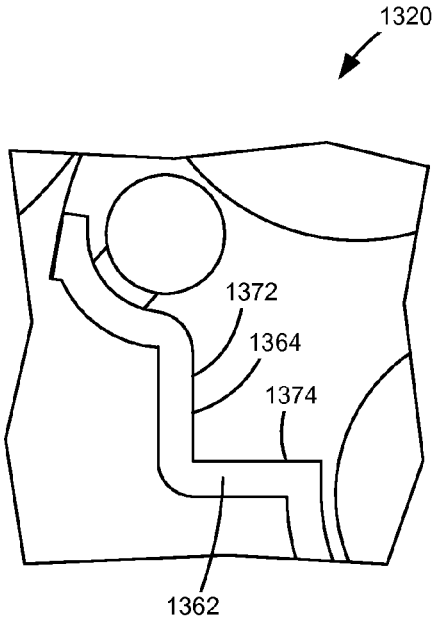
FIG. 6 is a cross-sectional view of a developer unit according to a second embodiment.
Figure 7:
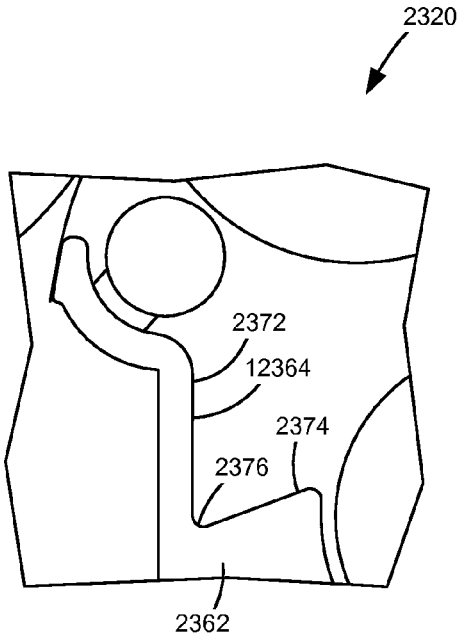
FIG. 7 is a cross-sectional view of a developer unit according to a third embodiment.

If the slope of front portion 372 of concave inner surface 364 is too steep, stagnation of the developer mix near the corner of front portion 372 and bottom portion 374 may occur reducing the ability to properly charge the toner and creating a risk of print defects if undercharged toner is picked up by sleeve 344 since the undercharged toner may not be attracted by the latent image on PC drum 310. For example, FIG. 6 shows a developer unit 1320 having a ledge 1362 similar to ledge 362 except that a front portion 1372 of an inner surface 1364 of ledge 1362 is substantially vertical and a bottom portion 1374 of inner surface 1364 of ledge 1362 is substantially horizontal. As a result, developer mix may tend to stagnate near the corner of front portion 1372 and bottom portion 1374. Similarly, stagnation of developer mix may occur if ledge 362 includes sharp corners. For example, FIG. 7 shows a developer unit 2320 having a ledge 2362 similar to ledge 362 except that a front portion 2372 of an inner surface 2364 of ledge 2362 is nearly vertical and a bottom portion 2374 of inner surface 2364 of ledge 2362 is angled upward with respect to horizontal such that a corner 2376 is formed between front portion 2372 and bottom portion 2374 where developer mix may tend to stagnate.

Figure 8:
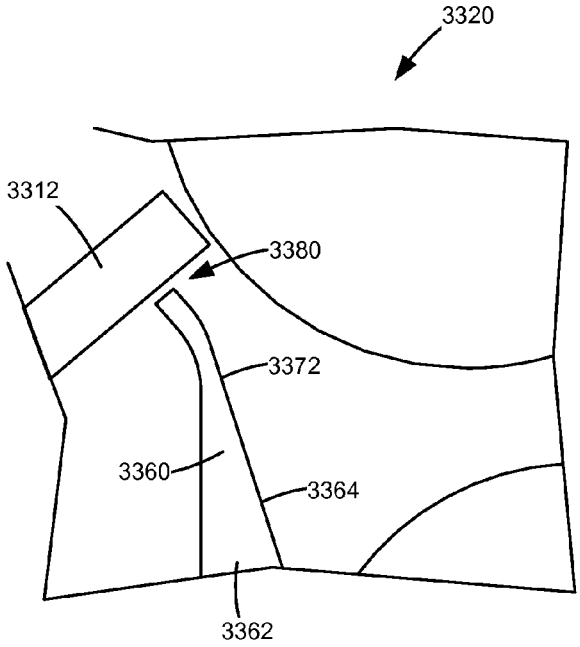
FIG. 8 is a cross-sectional view of a developer unit according to a fourth embodiment.

In contrast, if the slope of front portion 372 of concave inner surface 364 is too shallow, surface 364 may tend to encourage developer mix from reservoir 302 to leak through a gap 380 between trim bar 312 and front wall 360 if developer unit 320 is dropped during shipping or handling. For example, FIG. 8 shows a developer unit 3320 having a ledge 3362 similar to ledge 362 except that a front portion 3372 of an inner surface 3364 of ledge 3362 forms an angle of about 25 degrees with respect to vertical when developer unit 3320 is in its operative orientation. If developer unit 3320 is dropped (particularly if developer unit 3320 is dropped with its front or one of its sides facing the ground), the relatively shallow slope of front portion 3372 of inner surface 3364 directs the developer mix into gap 3380 between trim bar 3312 and front wall 3360 potentially causing developer mix to leak through gap 3380. In contrast, the relatively steeper slope of front portion 372 of inner surface 364 of developer unit 320 reduces the amount of developer mix directed into gap 380 when developer unit 320 is dropped thereby reducing the potential for leakage of developer mix from reservoir 302 through gap 380. In order to combat the possibility of developer mix leakage from a dropped developer unit, some developer unit manufacturers include a toner dam that temporarily seals the portion of the developer mix reservoir near the trim bar and that is removed by the customer prior to installing the developer unit in the image forming device. In some embodiments, developer unit 320 does not require such a toner dam due to the slope of front portion 372 of inner surface 364.

With reference back to the enlarged portion of FIG. 4, in one embodiment, a radial distance R with respect to magnetic roll 306 from the outer surface of sleeve 344 to bottom rear edge 370 of ledge 362 is between about 6 mm and about 13 mm including all values and increments there between such as, for example between about 8 mm and about 12 mm. In one embodiment, a horizontal distance H when developer unit 320 is in its operative orientation from centerline 313 of trim bar 312 to a virtual line extending vertically from bottom rear edge 370 of ledge 362 is between about 6 mm and about 12 mm.

If region 366 is too large or open, e.g., if the radial distance R is too large or if the horizontal distance H is too large, portions of the developer mix in region 366 may be too far from the magnetic field of the magnetic poles of core 342 to be picked up by sleeve 344 and may be too far from auger 340*b* to mix properly. As a result, stagnation of portions of the developer mix may occur reducing the ability to properly charge the toner and creating a risk of print defects.

Figure 9:
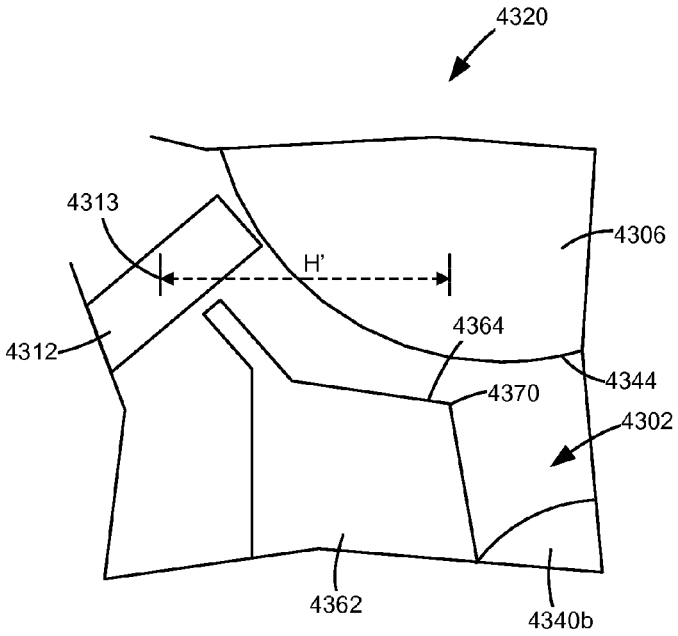
FIG. 9 is a cross-sectional view of a developer unit according to a fifth embodiment.

On the other hand, if region 366 is too small or necked down, e.g., if the radial distance R is too small and the horizontal distance H is too large, the torque required to drive magnetic roll 306 increases requiring additional energy to operate developer unit 320. Further, the forces on the developer mix in region 366 increase when region 366 is too small or necked down thereby increasing the wear on the magnetic carrier beads which may decrease the useful life of the developer unit 320. For example, FIG. 9 shows a developer unit 4320 having a ledge 4362 similar to ledge 362 except that bottom rear edge 4370 of inner surface 4364 is positioned closer to the outer surface of sleeve 4344 of magnetic roll 4306. Further, the horizontal distance H' when developer unit 4320 is in its operative orientation from centerline 4313 of trim bar 4312 to bottom rear edge 4370 of ledge 4362 is larger than that of ledge 362. As a result, significantly more torque may be required to drive magnetic roll 4306 of developer unit 4320 and the carrier beads in reservoir 4302 may experience increased wear.

The foregoing description illustrates various aspects and examples of the present disclosure, it is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A developer unit for a dual component development electrophotographic image forming device, comprising:

a housing having a reservoir for storing a developer mix that includes toner and magnetic carrier beads;

a magnetic roll on a front of the housing, the magnetic roll including a stationary core and a sleeve positioned around the core that is rotatable relative to the core about an axis of rotation, the stationary core includes at least one permanent magnet having a plurality of circumferentially spaced magnetic poles, the plurality of circumferentially spaced magnetic poles includes a pickup pole that is positioned to magnetically attract developer mix in the reservoir to the outer surface of the sleeve for carrying by the sleeve as the sleeve rotates;

a trim bar positioned in close proximity to the outer surface of the sleeve downstream from the pickup pole relative to an operative rotational direction of the sleeve to trim the developer mix on the outer surface of the sleeve prior to carrying the developer mix to a photoconductive drum of the image forming device;

an auger positioned to convey developer mix in the reservoir toward the outer surface of the sleeve for pickup by the outer surface of the sleeve;

a ledge on an inner surface of the housing extending axially with respect to the magnetic roll along a front of the reservoir, the ledge positioned upstream from the trim bar and downstream from the pickup pole with respect to the operative rotational direction of the sleeve, the ledge has a concave curved inner surface that is open to the reservoir and extends from a top front edge of the ledge positioned near the trim bar to a bottom rear edge of the ledge positioned near a front side of the auger.

2. The developer unit of claim 1, wherein the concave curved inner surface includes a front portion that faces primarily rearward and a bottom portion that faces primarily upward and the front portion has a greater radius of curvature than the bottom portion.

3. The developer unit of claim 1, wherein the concave curved inner surface includes a front portion that faces primarily rearward and a bottom portion that faces primarily upward and the front portion is sloped such that a line drawn between the top front edge of the ledge and a bottom point of the front portion where the concave curved inner surface transitions from facing primarily rearward to primarily upward forms an angle of between about 6 degrees and about 15 degrees with respect to vertical when the developer unit is in its operative orientation.

4. The developer unit of claim 3, wherein the front portion is sloped such that the line drawn between the top front edge of the ledge and the bottom point of the front portion where the concave curved inner surface transitions from facing primarily rearward to primarily upward forms an angle of between about 7 degrees and about 13 degrees with respect to vertical when the developer unit is in its operative orientation.

5. The developer unit of claim 1, wherein a radial distance relative to the magnetic roll from the outer surface of the sleeve to the bottom rear edge of the ledge is between about 6 mm and about 13 mm.

6. The developer unit of claim 5, wherein the radial distance relative to the magnetic roll from the outer surface of the sleeve to the bottom rear edge of the ledge is between about 8 mm and about 12 mm.

7. The developer unit of claim 1, wherein a horizontal distance from a centerline of the trim bar to a virtual line extending vertically from the bottom rear edge of the ledge is between about 6 mm and about 12 mm when the developer unit is in its operative orientation.

8. A developer unit for a dual component development electrophotographic image forming device, comprising:

a housing having a reservoir for storing a developer mix that includes toner and magnetic carrier beads;

a magnetic roll on a front of the housing, the magnetic roll including a stationary core and a sleeve positioned around the core that is rotatable relative to the core about an axis of rotation, the stationary core includes at least one permanent magnet, the outer surface of the sleeve is positioned to carry developer mix attracted from the reservoir to the outer surface of the sleeve by the at least one permanent magnet;

a trim bar positioned in close proximity to the outer surface of the sleeve to trim the developer mix on the outer surface of the sleeve prior to carrying the developer mix to a photoconductive drum of the image forming device;

an auger positioned to convey developer mix in the reservoir toward the outer surface of the sleeve for pickup by the outer surface of the sleeve;

a ledge on an inner surface of the housing extending axially with respect to the magnetic roll along a front of the reservoir, the ledge positioned vertically below a bottommost point of the outer surface of the sleeve and vertically above a centerline of the auger when the developer unit is in its operative orientation, the ledge has a concave curved inner surface that is open to the reservoir and extends from a top front edge of the ledge positioned near the trim bar to a bottom rear edge of the ledge positioned near a front side of the auger, an upper portion of the auger extends vertically higher than the bottom rear edge of the ledge when the developer unit is in its operative orientation.

9. The developer unit of claim 8, wherein the concave curved inner surface includes a front portion that faces primarily rearward and a bottom portion that faces primarily upward and the front portion has a greater radius of curvature than the bottom portion.

10. The developer unit of claim 8, wherein the concave curved inner surface includes a front portion that faces primarily rearward and a bottom portion that faces primarily upward and the front portion is sloped such that a line drawn between the top front edge of the ledge and a bottom point of the front portion where the concave curved inner surface transitions from facing primarily rearward to primarily upward forms an angle of between about 6 degrees and about 15 degrees with respect to vertical when the developer unit is in its operative orientation.

11. The developer unit of claim 10, wherein the front portion is sloped such that the line drawn between the top front edge of the ledge and the bottom point of the front portion where the concave curved inner surface transitions from facing primarily rearward to primarily upward forms an angle of between about 7 degrees and about 13 degrees with respect to vertical when the developer unit is in its operative orientation.

12. The developer unit of claim 8, wherein a radial distance relative to the magnetic roll from the outer surface of the sleeve to the bottom rear edge of the ledge is between about 6 mm and about 13 mm.

13. The developer unit of claim 12, wherein the radial distance relative to the magnetic roll from the outer surface of the sleeve to the bottom rear edge of the ledge is between about 8 mm and about 12 mm.

14. The developer unit of claim 8, wherein a horizontal distance from a centerline of the trim bar to a virtual line extending vertically from the bottom rear edge of the ledge is between about 6 mm and about 12 mm when the developer unit is in its operative orientation.

* * * * *